United States Patent [19]

D'Onofrio

[11] Patent Number: 4,789,368

[45] Date of Patent: Dec. 6, 1988

[54] RESCUE FIN

[76] Inventor: Vincent G. D'Onofrio, P.O. Box 986, Paia Maui, Hi. 96779

[21] Appl. No.: 103,065

[22] Filed: Sep. 30, 1987

[51] Int. Cl.[4] ..... B63H 9/06

[52] U.S. Cl. ..... 441/79; 114/140; 114/39.2; 441/74

[58] Field of Search ..... 441/74, 79; 114/363, 114/140, 39.2, 39.1, 343, 36.4; 440/38, 40, 41

[56] References Cited

U.S. PATENT DOCUMENTS

| | | | |
|---|---|---|---|
| 3,707,935 | 1/1973 | Rachie | 441/74 |
| 4,421,492 | 12/1983 | Leva | 441/79 |
| 4,508,046 | 4/1985 | Coulter et al. | 441/74 |

FOREIGN PATENT DOCUMENTS

| | | | |
|---|---|---|---|
| 2938211 | 4/1981 | Fed. Rep. of Germany | 441/74 |

*Primary Examiner*—Joseph F. Peters, Jr.
*Assistant Examiner*—Edwin L. Swinehart
*Attorney, Agent, or Firm*—John G. Abramo

[57] ABSTRACT

A rescue fin is a device for repairing a broken skeg box on a sailboard without the need to take the sailboard to a repair shop. The rescue fin is strapped to the rear part of the sailboard so that the skeg box of the rescue fin is positioned above the broken skeg box and is strapped in place using straps positioned on both sides of the skeg board. the device can be carried on the sailboard or by the operator of the sailboard and can be installed on shore or in the water.

5 Claims, 3 Drawing Sheets

RESCUE FIN

FIELD OF THE INVENTION

This invention relates to wind surfing boards. Specifically, this invention relates to a device used with a wind surfing board to replace a broken fin.

BACKGROUND AND DISCUSSION OF THE PRIOR ART

Wind surfing involves the application of a sail to a surfing board. Wind surfing, in recent years, has become a very popular activity involving a large number of people. Wind surfing activity has included travels across large bodies of water and recently a Trans-Atlantic voyage was complete using a wind surfing device. All wind sailboards require a fin for directional control, and also to stabilize the sailboard in the water so that the board will move forward rather than slide sideways. Thus, the fin performs similar to the centerboard or keel in a conventional sailboat and is important in maintaining the sailboard in the desired direction. If the fin breaks off, it is difficult, if not impossible, to use the sailboard and sail. Normally, this would cause inconvenience, but would not be dangerous. However, wind surfers are venturing further and further from shore and if the fin on their sailboard should break and the user had no means of repairing the board or replacing the fin, the wind surfer could be in grave danger of drowning if he happened to venture out so far that he would not be able to return by the time darkness fell.

The standard sailboard fin is attached to the bottom of a sailboard by means of pins that fit into groves in a rectangular structure built into the bottom of a sailboard which is called a skeg box. The fin projects down into the water. The fin is not able to withstand direct blows such as those that result from contact with large creatures in the water, sunken logs, rocks, or anything that might be present in the water having some weight and size compared to the fin. The fin itself can be broken and usually the skeg box holding the fin will be also be broken.

If the skeg box is broken the groves that engage pins on the fin that hold the fin in place are also broken there would be no way to hold the fin in its place and alignment. The necessary result of such breakage would be that the wind surfer would not be able to return to shore using the sail, because the loss of the fin effectively disables the sailboard. It would be possible to paddle the sailboard, but that would be difficult to do because the sail would get in the way, and in any event, it would take a much longer time and require a great deal more effort. It is possible that in some circumstances, especially if the wind surfer was far out at sea, or if tides or the winds opposed his direction of return, the wind surfer might not be able to return to shore.

There are no prior art devices which correct these problems. Kollum, Jr., in U.S. Pat. No. 4,325,154 describes a fin that might be carried along and used on surfboards if the fin in the skeg box broke. However, it is clear that the subject matter claimed in the patent and the disclosure of the patent only relates to a fin that is capable of being repaired on shore in a workshop and does not provide a method of repair if the surfboard is disabled in the water far from shore. It does not suggest a situation if the skeg box is broken. Morey, in U.S. Pat. No. 3,422,471 describes a surfboard with a removable fin. However, as mentioned previously, if the skeg box is broken, it would not be possible to mount the replacement fin in the broken skeg box, and the teaching of this particular patent does not solve the above mentioned problems. Another invention to Morey, U.S. Pat. No. 3,516,099, describes another embodiment of a removable surfboard fin. However, its teaching fails to solve the problems of a wind surfing device with a broken skeg box. Lambach, in U.S. Pat. No. 3,308,493 describes another surfboard which provides an adjustable keel for a surfboard. However, this disclosure provides merely for the variable placement of the keel in a surfboard in order to accommodate people of different weight and also to accommodate different surfing conditions. The disclosure does not discuss the utility of the device on wind surfing equipment, and in any event, does not disclose how the device would be useful in case the mounting structure for the keel or fin is broken.

It is the object of this invention to provide a wind surfing rescue fin which may be easily mounted on a sailboard that has been damaged by the breaking or loss of the conventional fin and its skeg box. It is a further object of this invention to provide a device which is easily put on a surfboard when the wind surfer is in water some distance from the shore.

The aforesaid, as well as other objects and advantages, will become apparent from the following description, the adjoined claims and the drawings.

SUMMARY OF THE INVENTION

The invention is a device for temporarily repairing sailboards if they are damaged while in use by breakage of the fin or the skeg box. The device comprises a base member having non-slip means on the side of the base member that is to be in contact with the sailboard a skeg box on the other side of the base member which is adapted to receive a replacement fin. The rescue fin is attached to the rear of the sailboard so that its skeg box is located approximately over the broken skeg box of the sailboard. The replacement fin extends down in the water when the sailboard is returned to use just as the original equipment fin does.

A sailboard can be placed back in use by attaching the rescue fin to a sailboard without seeking extensive repairs at a workshop.

DESCRIPTION OF THE PREFERRED EMBODIMENTS

Figure 1:
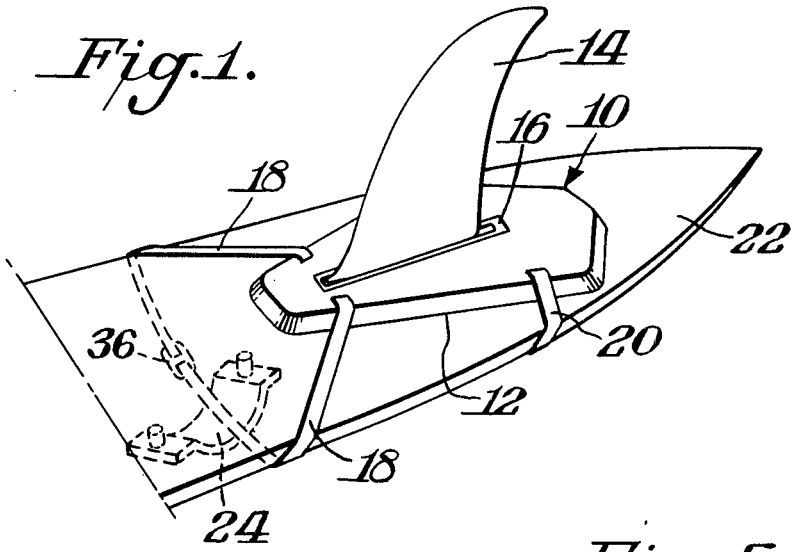
FIG. 1 is a pictorial view of the rescue fin of this invention.

Referring to FIG. 1, there is shown the rescue fin 10, the rescue fin base 12, the replacement fin 14, the skeg box 16, the aft straps 18, and the forward straps 20. It is apparent that the rescue fin 14 fits into the box-like structure known as a skeg box 16, which is embedded in the base 12 of the rescue fin. The entire rescue fin is mounted on a sailboard 22, by means of forward straps 20 and aft straps 18. The aft straps 18 pass through foot inserts 24 on the top surface of the sailboard 22.

Figures 2, 3:
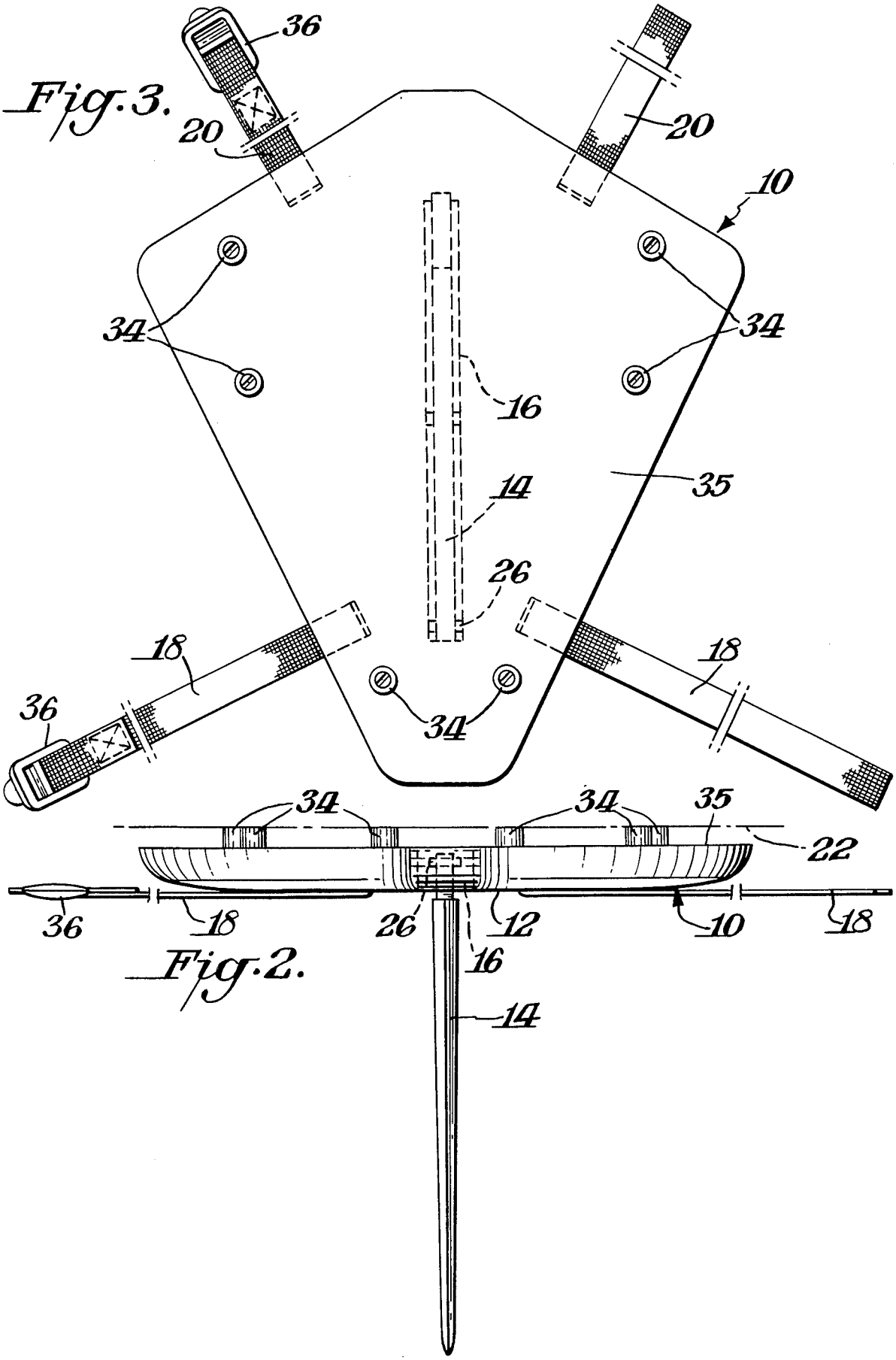
FIG. 2 is a front elevational view of the invention showing the sailboard in phantom.
FIG. 3 is a top plan view of the rescue fin.

Referring now to FIG. 2, the rescue fin 10 after the replacement fin 14 is inserted into the skeg box 16 of the rescue fin base 12 is positioned under the sailboard 22 with rubber protuberances 34 being in contact with the bottom of the sailboard 22. The rubber protuberances 34 serve to provide non-slip contact with the sailboard 22, and thereby keep the rescue fin 10 in place when the operator resumes wind surfing.

FIG. 3 shows the rescue fin with the forward straps 20 and aft straps 18 stretched out. The aft straps 18 and the front straps 20 have buckles 36 which engage their opposing end straps and enable the straps to be drawn up tight over the top of the sailboard 22 and hold the rescue fin 10 in place. This aspect of the invention is shown in more detail in FIG. 5. The protuberances 34 are positioned along the top surface 35 of the rescue fin base 12 in any suitable pattern. The pattern shown in FIG. 3 is one suitable arrangement for those rubber protuberances.

Figure 5:
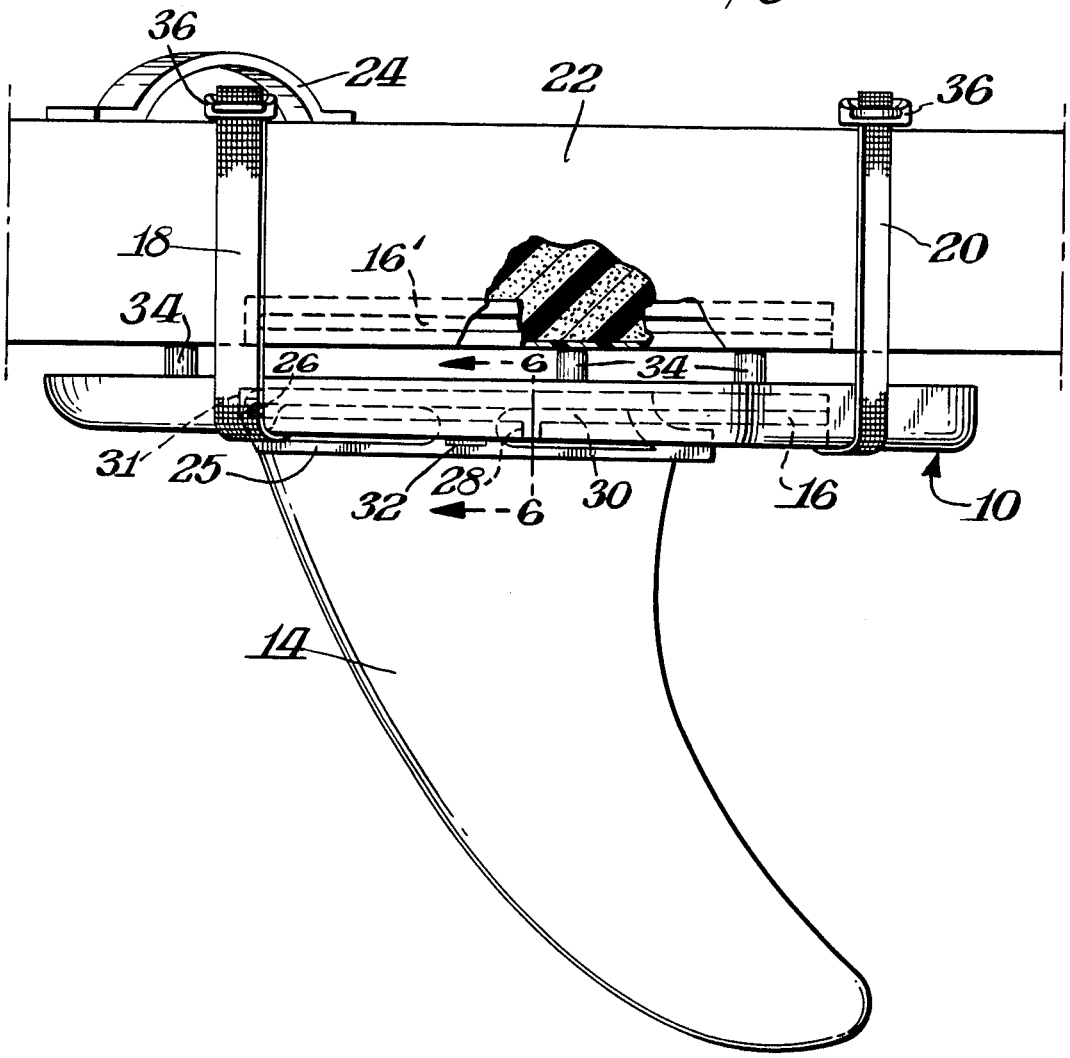
FIG. 5 is a side elevational view of the rescue fins shown attached to a portion of a sailboard.
Figure 4:
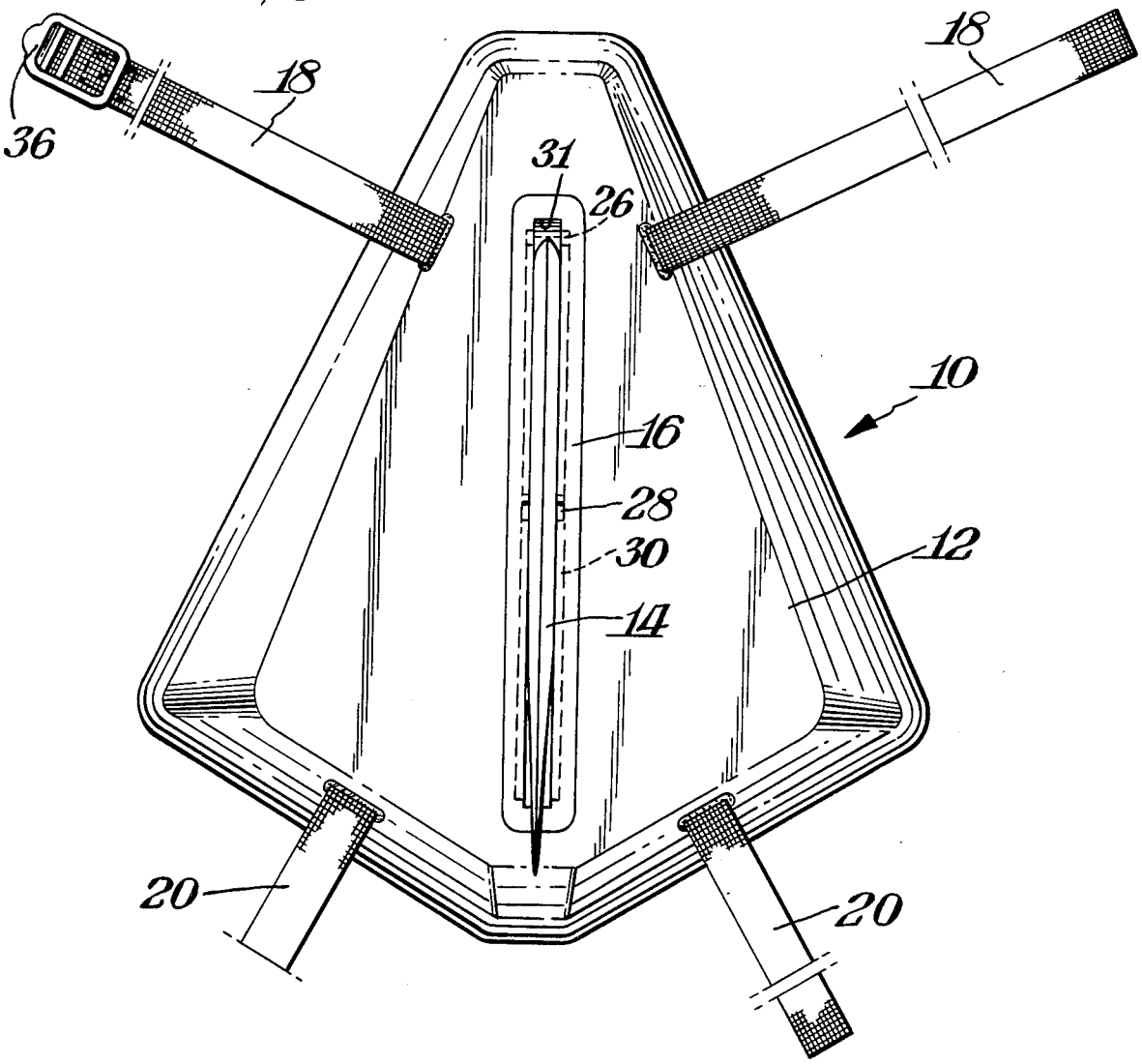
FIG. 4 is a bottom plan view of the rescue fin.

Referring to FIG. 4 and FIG. 5, the rescue fin is strapped to the sailboard 22 through straps 18 and 20 as shown. A broken skeg box 16' is illustrated in FIG. 5. The front straps 18 conveniently pass through the foot straps 24 on the sailboard.

Figure 6:
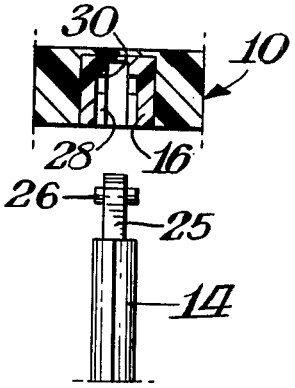
FIG. 6 is a cross-sectional view along line 6—6 of FIG. 5.
Figure 7:
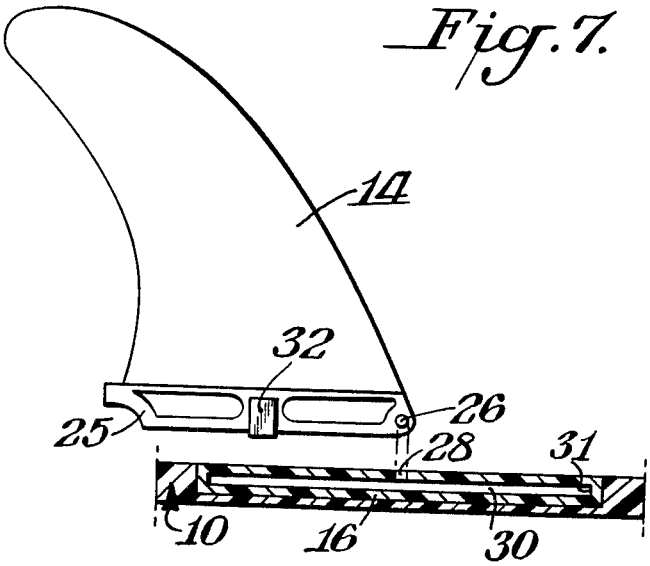
FIG. 7 is a side elevational view partially in cross section showing the rescue fin being inserted in the skeg box.

Referring to FIG. 6, the replacement fin 14 has a rescue fin base 25 which has a pin 26. Referring to FIG. 7, the skeg box 16 has a entry slot 28 and a longitudinal slot 30. The pin 26 in the replacement fin base 25 engages the entry slot 28 and is pushed into that slot until it reaches the longitudinal slot 30, and is then pushed forward until it reaches the end of that slot 31. The tape 32 on the replacement fin base 25 helps to provide a tight friction fit of the rescue fin 14 in the skeg box 16.

The rescue fin 10 is usually carried with the replacement fin 14 disengaged from the skeg box 16 in the rescue fin base 10. It is conveniently carried in a back pack or any suitable container usually of a fabric or vinyl type. The pack can be carried by the wind surfer or it can be strapped to the mast of the sail.

If the regular fin in the wind sail board is broken, the wind surfer removes the rescue fin base 12 with its accompanying straps from any container that it is in and positions the replacement fin 14 in the skeg box 16, and thereafter, the rescue fin 10 is positioned on the bottom of the wind surfing board and the straps 18 and 20 are tightened up by means of the buckles 36. The aft straps 18 are passed through the foot straps 24 on the sail board 22. After tightening the straps, the wind surfer can then resume his position on the top of the board and return to the shore to obtain repairs on the equipment or if desired, can continue wind surfing.

While this invention has been described for use on wind surfing equipment, it is clear that the invention can also be utilized on regular surfing boards and would allow the surfer to continue his activities without the need to seek repairs.

The means of attaching the device to the sailboard has been exemplified using straps, however any means of attaching the rescue fin to the sailboard is intended including, for example bolting the device to the bottom of a sailboard if the board is adapted to receive bolts. Likewise, the device can be made of fiberglass, wood, metal or any plastic material.

I claim:

1. A rescue fin which is carried on a sailboard, wherein attachment of the rescue fin enables a sailboard operator to resume windsurfing when the existing fin system is damaged, consisting of a replacement fin; a base having a top which has non-slip means thereon and a bottom which has a skeg box adapted to receive the replacement fin; attachment means for attaching the base to the sailboard whereby the non-slip means is placed against the bottom of the sailboard and the replacement fin is inserted into the skeg box so that the replacement fin is positioned down in the water when the rescue fin is in use on the sailboard.

2. A device, as in claim 1, wherein the fin and the base are made of plastic material.

3. A device as in claim 1, wherein the rescue fin is attached to the board by straps.

4. A device as in claim 1, wherein the top surface of the base has rubber protuberances that are in contact with the board and prevent the rescue fin from slipping from the position selected for it on the bottom of the sailboard.

5. The method of repairing a sailboard with a damaged fin which comprises, removing the broken or damaged sailboard fin, placing on the bottom of a sailboard a rescue fin having a base with strap means for attachment of the rescue fin to the sailboard, said rescue fin having a base with a top which has non-slip means thereon and a bottom which has a skeg box adapted to receive the replacement fin; attaching attachment means on the base to the sailboard whereby the non-slip means are placed against the bottom of the sailboard and placing the replacement fin inserted in the skeg box whereby the replacement fin is positioned down in the water when the rescue fin is in use with the sailboard.

* * * * *